US011652318B2

(12) United States Patent
Sato

(10) Patent No.: US 11,652,318 B2
(45) Date of Patent: May 16, 2023

(54) ELECTRICAL CONNECTOR WITH A FLAT-TYPE CONDUCTOR

(71) Applicant: Hirose Electric Co., Ltd., Kanagawa (JP)

(72) Inventor: Seitaro Sato, Kanagawa (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/501,892

(22) Filed: Oct. 14, 2021

(65) Prior Publication Data

US 2022/0123504 A1 Apr. 21, 2022

(30) Foreign Application Priority Data

Oct. 19, 2020 (JP) ..... JP2020-175547

(51) Int. Cl.
*H01R 13/627* (2006.01)
*H01R 12/79* (2011.01)

(52) U.S. Cl.
CPC ..... *H01R 13/6272* (2013.01); *H01R 12/79* (2013.01)

(58) Field of Classification Search
CPC ..... H01R 13/6271–6273; H01R 12/78; H01R 12/592; H01R 12/79; H01R 23/668
USPC ..... 439/358, 492, 495, 499
See application file for complete search history.

(56) References Cited

U.S. PATENT DOCUMENTS 5,660,557 A * 8/1997 Lemke ..... H01R 12/7005 439/328
6,299,476 B1 * 10/2001 Schramme ..... H01R 12/774 439/492
8,337,230 B1 * 12/2012 Kurachi ..... H01R 12/774 439/328
8,651,888 B2 * 2/2014 Kurachi ..... H01R 12/772 439/495
2008/0293262 A1 * 11/2008 Duesterhoeft ..... H01R 12/616 439/631
2014/0073179 A1 * 3/2014 Hashiguchi ..... H01R 9/0518 439/581
2015/0056840 A1 * 2/2015 Ohyama ..... H01R 12/774 439/350

(Continued)

FOREIGN PATENT DOCUMENTS

JP 5909410 B2 4/2016

*Primary Examiner* — Gary F Paumen
(74) *Attorney, Agent, or Firm* — Procopio, Cory, Hargreaves & Savitch LLP

(57) ABSTRACT

The housing has a locking portion, which is positioned within the range between the circuits positioned at the outermost ends in the strip width direction of the flat-type conductor and is lockable to the counterpart electrical connector, and a holding space, which holds the retainer along with the front end section of the flat-type conductor, the front end section of the flat-type conductor has formed therein a pass-through portion extending through the flat-type conductor in the thickness direction of said flat-type conductor at a location at least partially overlapping with the locking portion in the strip width direction, and the retainer has a protrusion that protrudes in the thickness direction of the flat-type conductor and enters the pass-through portion of the flat-type conductor, thereby making it possible to limit the rearward movement of the flat-type conductor with the help of said protrusion.

2 Claims, 12 Drawing Sheets

(56) References Cited

U.S. PATENT DOCUMENTS

2015/0111410 A1* 4/2015 Gingrich, III ..... H01R 12/771
439/358

* cited by examiner (A)

(B)

ELECTRICAL CONNECTOR WITH A FLAT-TYPE CONDUCTOR

CROSS-REFERENCE TO RELATED APPLICATIONS

This application claims priority to Japanese Patent Application No. 2020-175547, filed Oct. 19, 2020, the contents of which are incorporated herein by reference in its entirety for all purposes.

BACKGROUND

Technical Field

The present invention relates to an electrical connector with a flat-type conductor.

Background Art

A connector for matingly connecting a front end section of a flat-type conductor with a strip-like configuration extending in a forward-backward direction to a counterpart connector has been disclosed in Patent Document 1. The connector of Patent Document 1, which has a flat-type conductor (flat circuit) and a housing (slider) that holds and retains in place a front end section of said flat-type conductor, is matingly connected to a circuit board-mounted counterpart connector (board connector) from the rear.

The flat-type conductor has formed therein a plurality of circuits extending in the forward-backward direction that are arranged in the strip width direction of said flat-type conductor. Notch-shaped slider engagement apertures, which are intended for engagement with the housing, are formed on the opposite side edges of the front end section of said flat-type conductor, in other words, on each side of the circuit array range in the strip width direction. A slit-shaped circuit insertion aperture is formed in the housing along the top face of the bottom wall of said housing, and the front end section of said flat-type conductor is adapted to be inserted into said circuit insertion aperture from the rear. A locking portion (locking arm) intended for locking to a counterpart connector is provided at the center of the housing in the strip width direction and, in addition, at both ends of the housing in the strip width direction, in other words, at locations different from the locking portion, flexible engagement pieces engageable with the front end edges of said slider engagement apertures are provided at locations corresponding to the slider engagement apertures of the flat-type conductor. Said flexible engagement pieces have resilient pieces, which extend in the forward-backward direction and are resiliently deformable in the thickness direction of the flat-type conductor (up-down direction), and engagement projections, which protrude downwardly from said resilient pieces.

When the front end section of the flat-type conductor is attached to the housing, said front end section is inserted into the circuit insertion aperture of the housing from the rear and, upon abutting the engagement projections from the rear, is inserted further forward while resiliently deforming the resilient pieces upward. When the slider engagement apertures reach the location of the engagement projections, the resilient pieces return to the free state and the engagement projections enter the slider engagement apertures from above. As a result, the engagement projections are positioned so as to engage the front end edges of the slider engagement apertures from the rear, thereby preventing inadvertent decoupling of the flat-type conductor from the housing.

PATENT DOCUMENTS

[Patent Document 1]
Japanese Patent No. 5,909,410.

SUMMARY

Problems to be Solved

Generally speaking, a requirement that is often imposed upon electrical connectors with a flat-type conductor is profile reduction in the strip width direction of the flat-type conductor. However, according to Patent Document 1, preventing the decoupling of the flat-type conductor required forming slider engagement apertures at the opposite side edges of the flat-type conductor and also required providing flexible engagement pieces at the opposite ends of the housing, which made it difficult to reduce the dimensions of the electrical connector with a flat-type conductor in the strip width direction. In addition, the flexible engagement pieces were positioned differently from the locking portion, which also precluded reducing the dimensions of the electrical connector with a flat-type conductor in the strip width direction.

In view of the aforesaid circumstances, it is an object of the present invention to provide an electrical connector with a flat-type conductor that makes it possible to avoid an increase in the size of the flat-type conductor in the strip width direction while preventing inadvertent decoupling of the flat-type conductor from the housing.

Technical Solution

The inventive electrical connector with a flat-type conductor is an electrical connector with a flat-type conductor intended for matingly connecting a front end section of a flat-type conductor with a strip-like configuration extending in the forward-backward direction to a counterpart electrical connector, and comprises said flat-type conductor, which has formed therein a plurality of circuits extending in the forward-backward direction that are arranged in the strip width direction of the flat-type conductor, a housing holding the front end section of the flat-type conductor, and a retainer attached to the housing for supporting the front end section of the flat-type conductor.

According to the present invention, in such an electrical connector with a flat-type conductor, the housing has a locking portion, which is positioned within the range between the circuits positioned at the outermost ends in the strip width direction of the flat-type conductor and is lockable to the counterpart electrical connector, and a holding space which holds the retainer along with the front end section of the flat-type conductor, the front end section of the flat-type conductor has formed therein a pass-through portion extending through the flat-type conductor in the thickness direction of said flat-type conductor at a location at least partially overlapping with the locking portion in the strip width direction, and the retainer has a protrusion that protrudes in the thickness direction of the flat-type conductor and enters the pass-through portion of the flat-type conductor, thereby making is possible to limit the rearward movement of the flat-type conductor with the help of said protrusion.

In the present invention, the protrusion of the retainer is introduced into the pass-through portion of the flat-type conductor and said protrusion is enabled for engagement with the front end edge of said pass-through portion, thereby limiting the rearward movement of the flat-type conductor and preventing inadvertent decoupling of the flat-type conductor from the housing. As disclosed herein, the pass-through portion of the flat-type conductor and the protrusion of the retainer are positioned within the range between the circuits positioned at the outermost ends in the strip width direction of the flat-type conductor. Therefore, an increase in the size of the electrical connector with a flat-type conductor in the strip width direction can be avoided because in the present invention it is no longer necessary, as in the prior art, to provide a mechanism for preventing the decoupling of the flat-type conductor at more outer locations than the circuits positioned at the opposite ends in the strip width direction, in other words, at the outermost ends in the strip width direction.

In the present invention, the protrusion of the retainer may be positioned so as to be inserted into the pass-through portion of the flat-type conductor such that a protruding apex portion protrudes from the pass-through portion, and, in the walls that form the holding space, the housing may have a recessed portion that permits entry of the protruding apex portion of the protrusion, thereby making it possible to limit the movement of the protrusion in the strip width direction of the flat-type conductor along the inner surface of said recessed portion.

In this manner, being able to limit the movement of the protrusion of the retainer in the strip width direction of the flat-type conductor along the inner surface of the recessed portion of the housing makes it possible not only to prevent rearward decoupling of the retainer and, by extension, the flat-type conductor, but also to fix its position in the strip width direction.

In the present invention, the recessed portion of the housing may be formed in the shape of a rearwardly open groove extending in the forward-backward direction and may be adapted to permit entry of the protruding apex portion of the retainer from the rear.

In this manner, forming the recessed portion in the shape of a rearwardly open groove makes it possible to attach the retainer to the housing from the rear.

Technical Effect

In the present invention, as described above, the pass-through portion of the flat-type conductor and the protrusion of the retainer intended for preventing the decoupling of the flat-type conductor are positioned within the range between the circuits positioned at the outermost ends in the strip width direction of the flat-type conductor. Therefore, it is no longer necessary, as in the prior art, to provide a mechanism for preventing the decoupling of the flat-type conductor at more outer locations than the circuits positioned at the opposite ends in the strip width direction, in other words, at the outermost ends in the strip width direction. As a result, an increase in the size of the electrical connector with a flat-type conductor in the strip width direction can be avoided while preventing inadvertent decoupling of the flat-type conductor from the housing.

DETAILED DESCRIPTION

Embodiments of the present invention are described below with reference to the accompanying drawings.

Figure 1:
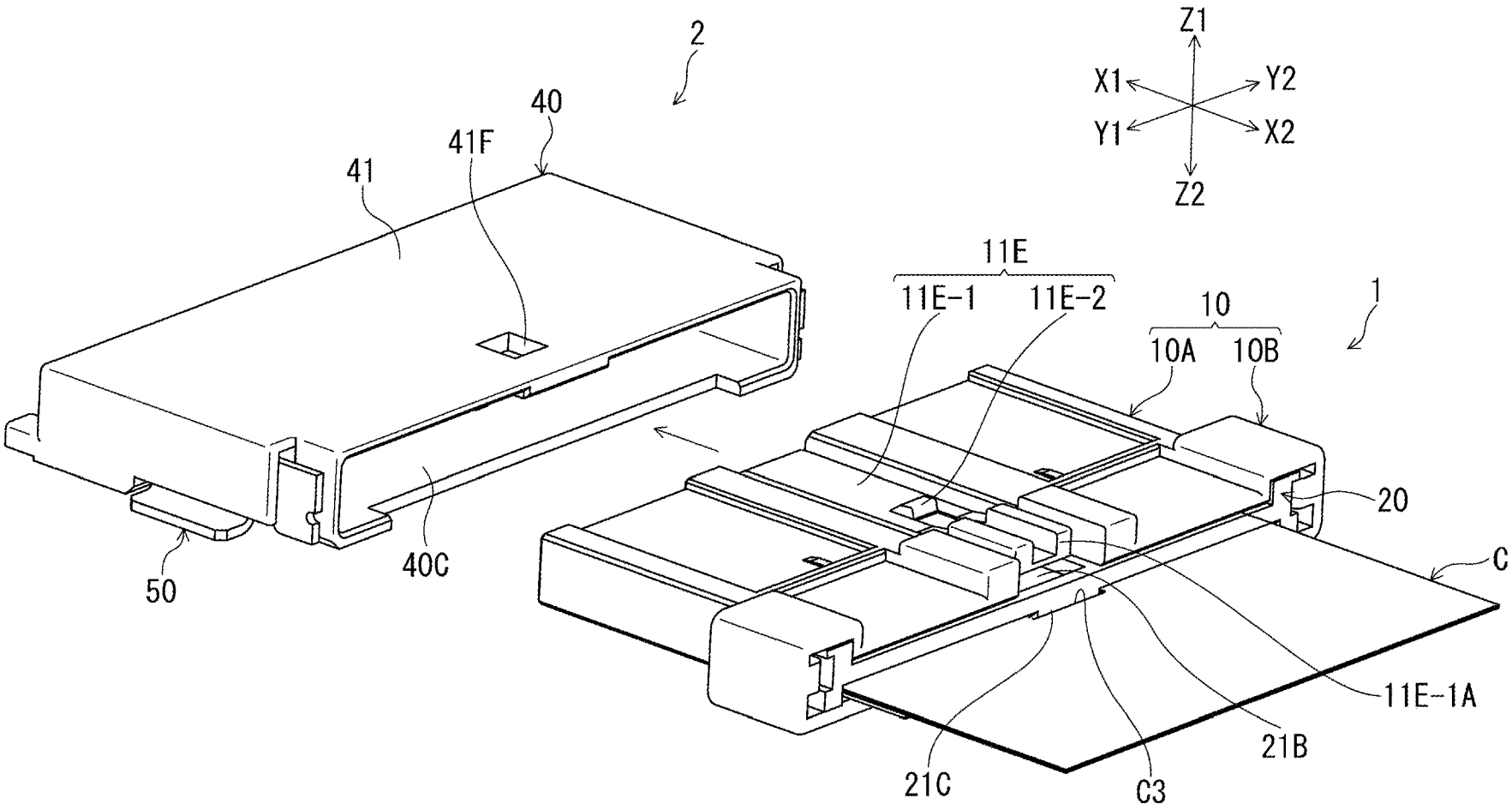
FIG. 1 illustrates a posterior perspective view of an electrical connector assembly according to an embodiment of the present invention, shown prior to connector mating.
Figure 2:
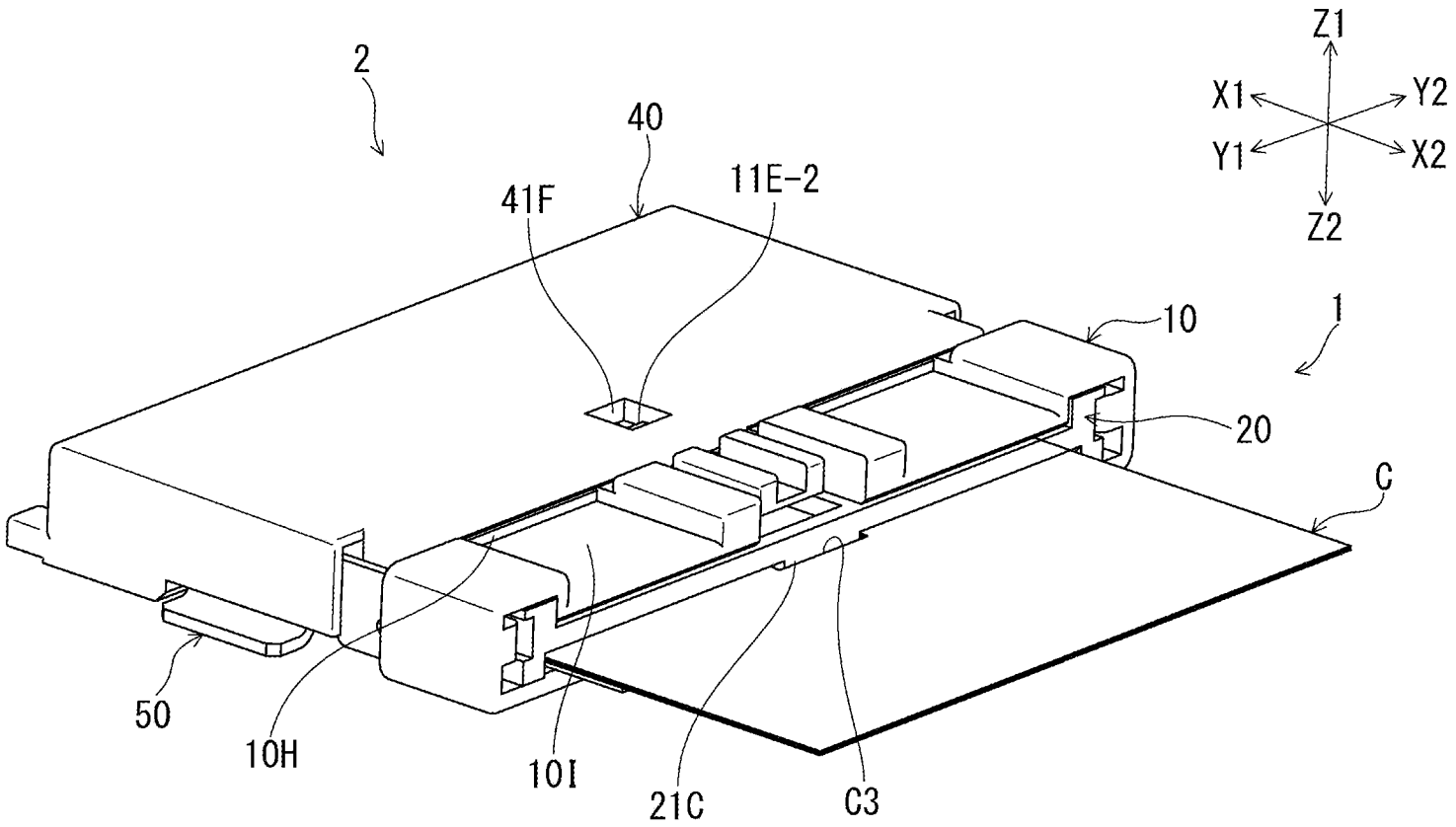
FIG. 2 illustrates a posterior perspective view of the electrical connector assembly of FIG. 1, shown after connector mating.
Figure 3:
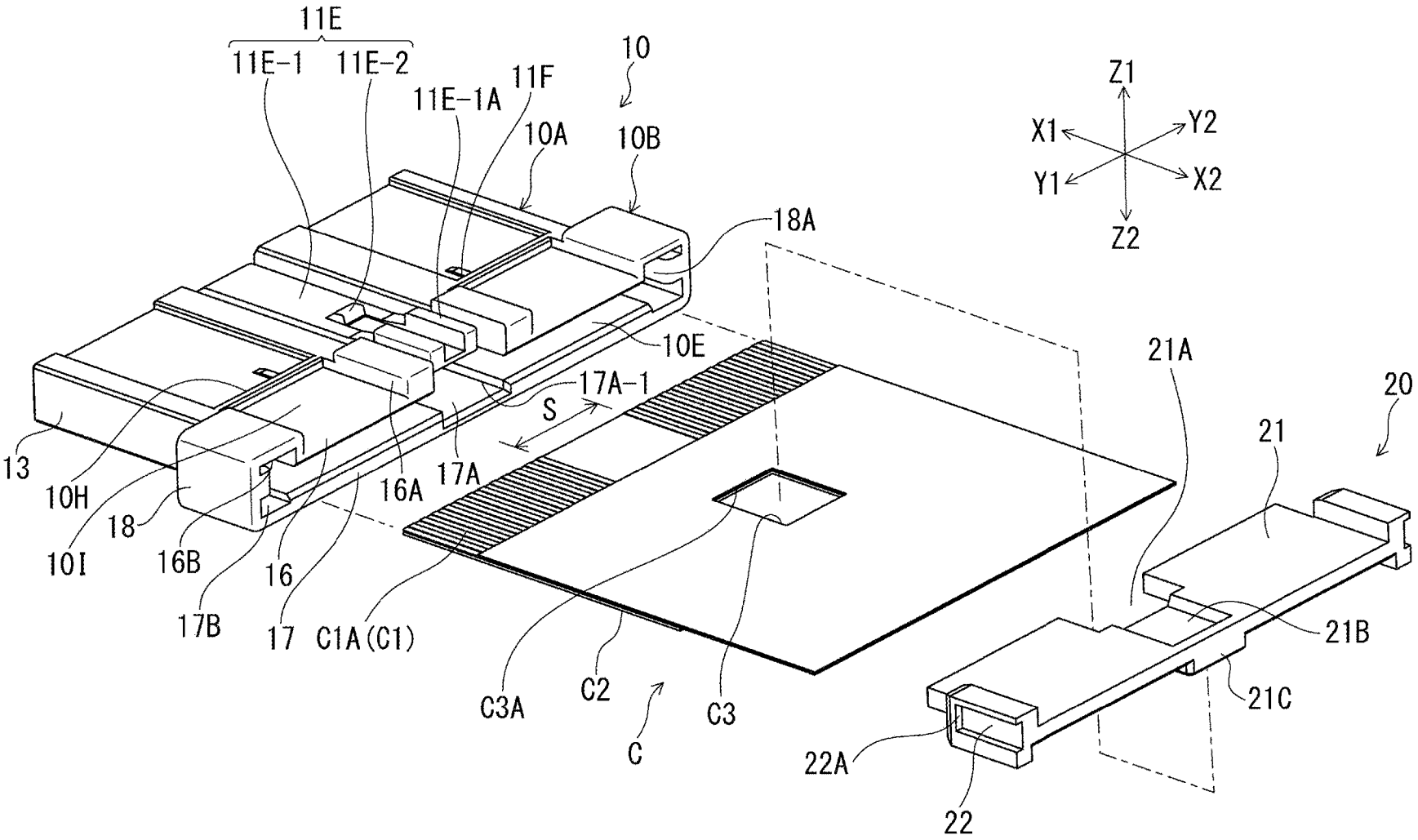
FIG. 3 illustrates an exploded perspective view of the components of the electrical connector with a flat-type conductor used in the electrical connector assembly of FIG. 1.

FIG. 1 and FIG. 2 are perspective views of the electrical connector assembly according to the present embodiment, shown prior to connector mating in FIG. 1 and after connector mating in FIG. 2. FIG. 3 is an exploded perspective view of the components of the electrical connector with a flat-type conductor used in the electrical connector assembly of FIG. 1. In the present embodiment, the electrical connector assembly comprises an electrical connector with a flat-type conductor 1 (referred to as "connector 1" below) and a counterpart electrical connector (referred to as "counterpart connector 2" below), which are removably connected such that the forward-backward direction (X-direction) is the direction of connector insertion and removal. The connector 1 is mated with the counterpart connector 2 mounted to a mounting face of a circuit board (not shown) in the forward direction (X1 direction), and is thus matingly connected to the counterpart connector 2.

The connector 1 comprises a flat-type conductor C extending in the forward-backward direction, a housing 10 holding a front end section of the flat-type conductor C, and a retainer 20 attached to the housing 10 such that it can support the front end section of the flat-type conductor C from the rear. The housing 10 and the retainer 20 are made of resin or another electrically insulating material.

Figure 4A:
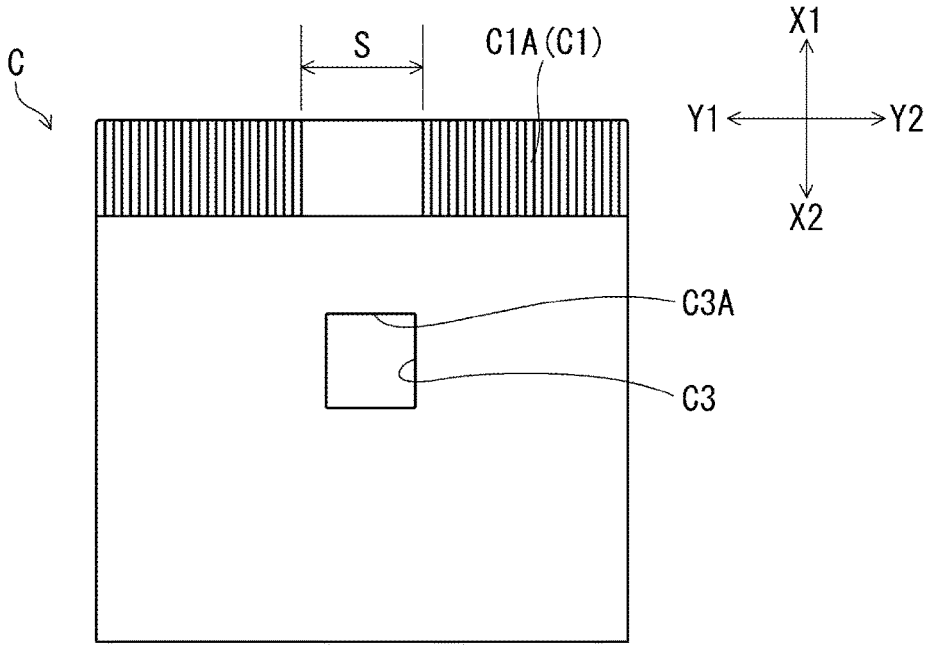
FIG. 4 (A) is a plan view of the flat-type conductor, and FIG. 4 (B) is a bottom view of the flat-type conductor.
Figure 4B:
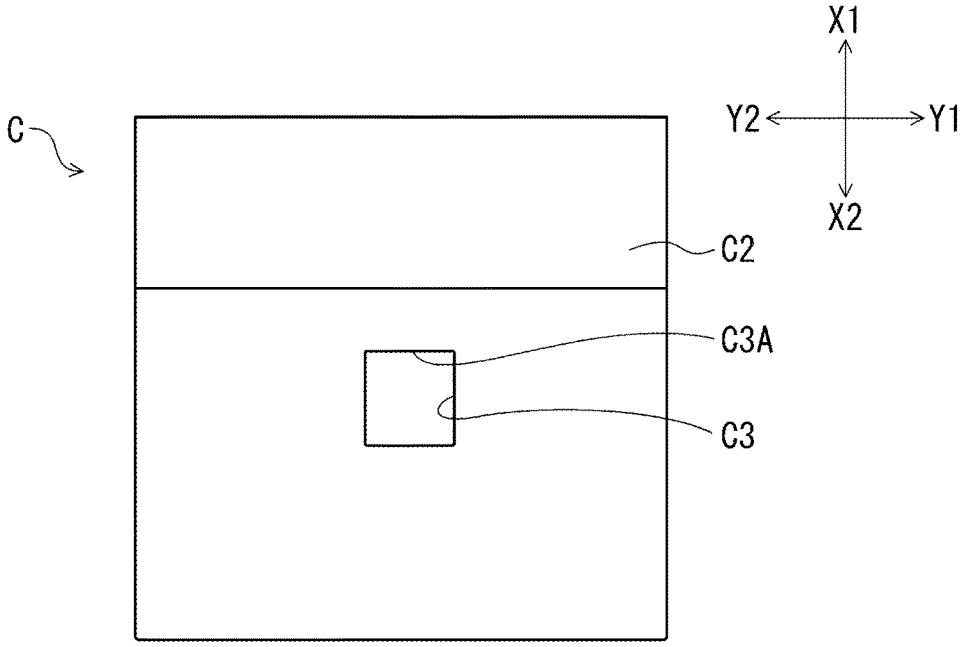

FIG. 4 (A) is a plan view of the flat-type conductor C, and FIG. 4 (B) is a bottom view of the flat-type conductor C. The flat-type conductor C has a strip-like configuration extending in the forward-backward direction (X-direction) such that the connector width direction (Y-direction) is the strip width direction. The flat-type conductor C has a plurality of circuits C1 extending in the forward-backward direction arranged thereon in the strip width direction of the flat-type conductor C (Y-direction). As can be seen in FIG. 4 (A), a circuit-free range S, in which no circuits are present, is formed in the central area of the flat-type conductor C in the strip width direction. That is to say, the plurality of circuits C1 are separated by the circuit-free range S in the strip width direction and divided into two circuit groups. The circuits C1 extend all the way to the front end of the flat-type conductor C (end on side X1). As can be seen in FIG. 4 (A), the circuits C1 have their front end sections exposed on the top face of the flat-type conductor C, and these exposed sections serve as contact portions C1A intended for contacting the hereinafter-described counterpart terminals 30 of the counterpart connector 2. As can be seen in FIG. 4 (B), a reinforcing plate C2 is adhered to the bottom face of a front end section of the flat-type conductor C in order to reinforce the front end section.

In addition, in the flat-type conductor C has formed therein a pass-through portion C3 disposed in the thickness direction of the flat-type conductor C, i.e., in the up-down direction (Z-axis direction) at a location rearward of the contact portions C1A within the circuit-free range S in the strip width direction. The pass-through portion C3 forms an aperture of a quadrangular shape and is disposed through both the main body of the flat-type conductor C and the reinforcing plate C2 (see FIG. 12 (C)). As described below, the pass-through portion C3 allows for the hereinafter-described protrusion 21C of the retainer 20 to be inserted therein from above, in other words, from the top side of the flat-type conductor C (see FIG. 7 (B), FIG. 12 (C)).

As can be seen in FIG. 4 (A) and FIG. 4 (B), in the present embodiment, the pass-through portion C3 is formed at a location slightly offset from the center of the flat-type conductor C in the strip width direction (Y-direction) toward side Y2. Positioning the pass-through portion C3 with an offset from the center in the strip width direction makes it possible to prevent the retainer 20 from being attached from the underside of the flat-type conductor C by mistake. In addition, in the present embodiment, the pass-through portion C3 is positioned within a range overlapping with the hereinafter-described locking portion 11E of the housing 10 in the connector width direction.

As can be seen in FIG. 3, the housing 10 has a substantially rectangular parallelepiped-like exterior configuration whose longitudinal direction is the connector width direction (Y-direction), and, along with having a mating portion 10A mating with the hereinafter-described counterpart housing 40 in substantially the front half (section on side X1) thereof, has a retainer installation portion 10B used for installing the retainer 20 from the rear in substantially the rear half (section on side X2) thereof. In addition, two partition walls 10C extending in the connector width direction (see FIG. 8) are provided within the interior space of the housing 10 at an intermediate location of the mating portion 10A in the forward-backward direction (X-direction), such that the interior space is divided by the partition walls 10C in the forward-backward direction. Specifically, the interior space is divided into two front receiving spaces 10D formed forwardly of the partition walls 10C and one rear receiving space 10E formed rearwardly of the partition walls 10C. The front receiving spaces 10D are spaces intended for receiving the hereinafter-described nested portions 44 of the counterpart connector 2 from the front when the connectors are put in a mated state. These front receiving spaces 10D are positioned in alignment with each of the two previously described circuit groups of the flat-type conductor C in the connector width direction. The rear receiving space 10E is a holding space intended for receiving the retainer 20 from the rear and holding it therein.

In addition, a space extending and expanding in the forward-backward direction across the inner surface (top face) of the bottom walls (the hereinafter-described front bottom wall 12 and rear bottom wall 17) of the housing 10 is formed to serve as a flat-type conductor insertion space 10F within the interior space of the housing 10 (see FIGS. 12 (A) and 12 (B)). The flat-type conductor insertion space 10F holds the front end section of the flat-type conductor C inserted from the rear (see FIGS. 12 (A) and 12 (B)). When the front end section of the flat-type conductor C is held within the flat-type conductor insertion space 10F, the top face of the bottom wall of the housing 10 is brought into surface contact or close proximity with the bottom face of the flat-type conductor C and can support the bottom face of the flat-type conductor C.

Figure 5A:
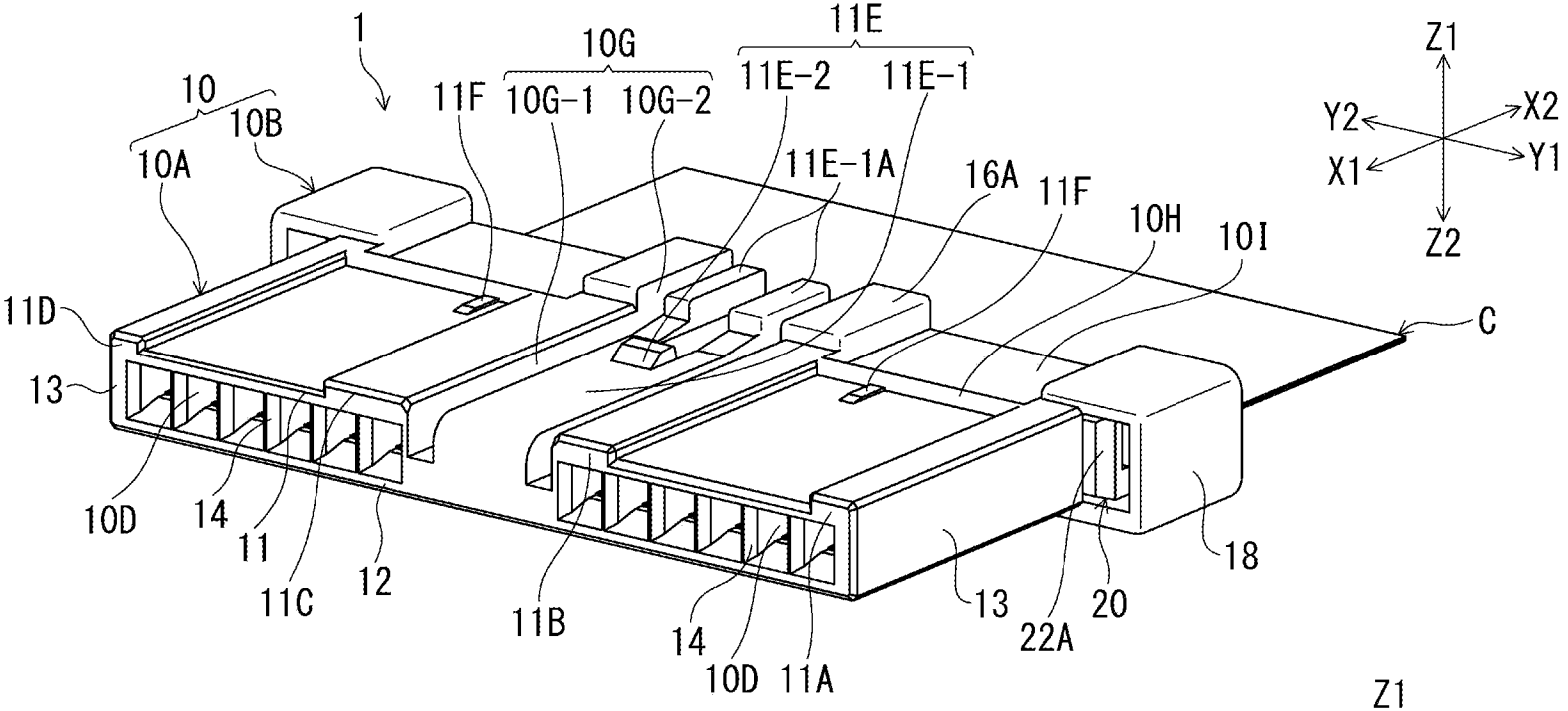
FIGS. 5 (A) and 5 (B) are views illustrating the electrical connector with a flat-type conductor used in the electrical connector assembly of FIG. 1 in isolation, where FIG. 5 (A) is an anterior perspective view, and FIG. 5 (B) is an anterior front view.
Figure 5B:
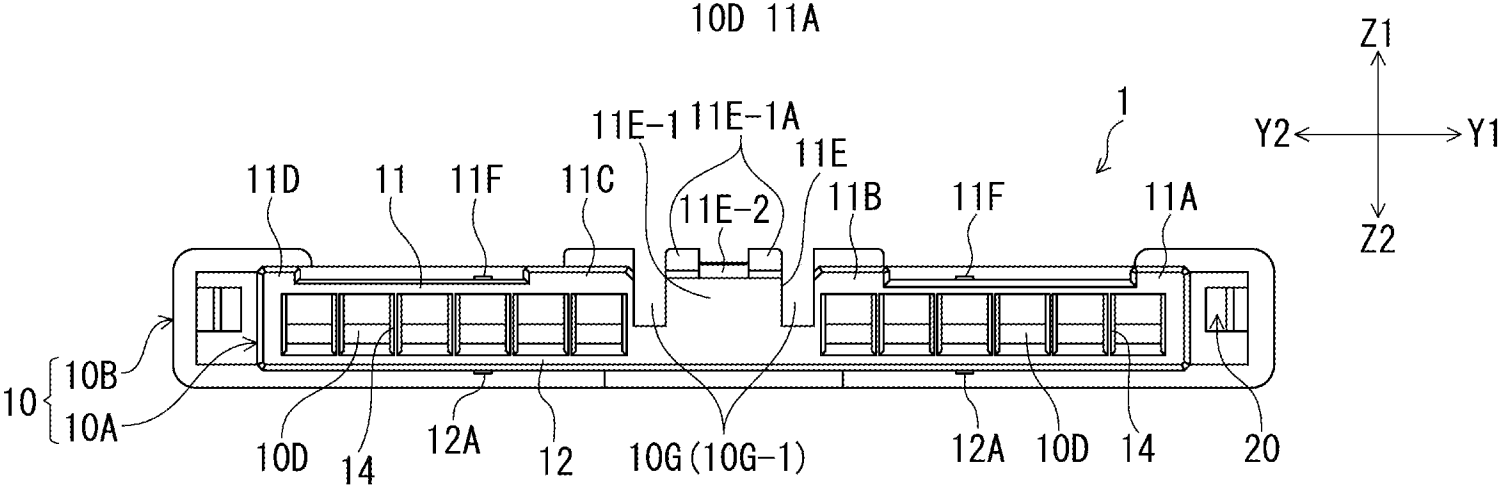

As can be seen in FIGS. 5 (A) and 5 (B), a locking portion holding space 10G intended for holding the hereinafter-described locking portion 11E is formed in the top walls of the housing 10 (the hereinafter-described front top wall 11 and rear top wall 16) in the central area in the connector width direction (within a range corresponding to the circuit-free range of the flat-type conductor C) and throughout the entire extent in the forward-backward direction. Within the bounds of the hereinafter-described front top wall 11 in the forward-backward direction, the locking portion holding space 10G includes a front holding space 10G-1 which, along with being recessed roughly to the center of the housing 10 in the up-down direction, extends throughout the entire extent of the front top wall 11 in the forward-backward direction, and, within the bounds of the hereinafter-described rear top wall 16 in the forward-backward direction, a rear holding space 10G-2 which, along with passing through the rear top wall 16 in the up-down direction, extends throughout the entire extent of the rear top wall 16 in the forward-backward direction. As can be seen in FIGS. 5 (A) and 5 (B), the bottom interior wall surface of the front holding space 10G-1, in other words, the top face of the front top wall 11, is in roughly the same position as the center of the receiving spaces 10D in the up-down direction.

The mating portion 10A comprises: a front top wall 11 and a front bottom wall 12, which serve as mating walls extending in the connector width direction and opposed in the up-down direction; a pair of front lateral walls 13, which extend in the up-down direction at the opposite ends in the connector width direction and couple the front top wall 11 to the front bottom wall 12; and a plurality of partition walls 14, which extend in the up-down direction and couple the front top wall 11 to the front bottom wall 12.

Protruding walls 11A-11D, which protrude from the top face of the front top wall 11 while extending in the forward-backward direction, are formed on the front top wall 11 at two locations in the intermediate area and at the opposite side edges in the connector width direction. Specifically, as can be seen in FIG. 3 and FIG. 5, the protruding walls 11A-11D include a first protruding wall 11A, a second protruding wall 11B, a third protruding wall 11C, and a fourth protruding wall 11D successively in a spaced relationship from side Y1 to side Y2. The first protruding wall 11A and fourth protruding wall 11D are positioned at the opposite side edges of the front top wall 11 in the connector width direction, and the second protruding wall 11B and third protruding wall 11C are positioned in the intermediate area of the front top wall 11 in the connector width direction. In the present embodiment, the protruding walls 11A-11D are formed such that the order of their decreasing width is: the third protruding wall 11C, second protruding wall 11B, first protruding wall 11A, and fourth protruding wall 11D. The previously discussed front holding space 10G-1 is formed between the second protruding wall 11B and third protruding wall 11C.

In addition, a cantilevered locking portion 11E extending rearwardly from the front end of the top face of the front top wall 11 to the rear end of the housing 10 is formed at the center of the front top wall 11 in the connector width direction. The locking portion 11E has a locking arm portion 11E-1 which extends in the forward-backward direction at a location spaced from the top face of the front top wall 11 and is resiliently deformable in the up-down direction, and a locking protrusion 11E-2 which serves as a locking engagement portion protruding upwardly at an intermediate location of the locking arm portion 11E-1 in the forward-backward direction. The locking portion 11E can be locked by engaging the hereinafter-described locking aperture 41F of the counterpart connector 2 with the locking protrusion 11E-2. In addition, the rear end portion (free end portion) of the locking arm portion 11E-1 serves as an operative portion 11E-1A, to which a pressing operation (unlocking operation) is applied from above for unlocking from the counterpart connector 2.

In the present embodiment, the locking arm portion 11E-1, with the exception of the operative portion 11E-1A, is held within the front holding space 10G-1 of the locking portion holding space 10G, and the operative portion 11E-1A is held within the rear holding space 10G-2 of the locking portion holding space 10G. In other words, the locking portion 11E is positioned within a range overlapping with the front receiving spaces 10D and rear receiving space 10E of the housing 10 (collectively referred to as "receiving spaces 10D, 10E" below whenever necessary) in the forward-backward direction. In addition, the locking protrusion 11E-2 is positioned so as to protrude above the front holding space 10G-1.

The locking portion 11E, along with being positioned differently from the position of the receiving spaces 10D, 10E when viewed in the up-down direction, is positioned such that the bottom portion of the locking arm portion 11E-1 overlaps with the receiving spaces 10D, 10E in the up-down direction (see FIGS. 5 (A) and 5 (B)). Therefore, in comparison with providing the locking portion above the receiving spaces of the housing, as in the prior art, in the present embodiment, greater profile reduction can be achieved by making the housing 10 and, by extension, the connector 1, smaller in the up-down direction in exact proportion to the overlap of the locking portion with the receiving spaces 10D, 10E.

As can be seen in FIGS. 5 (A) and 5 (B), a top ridge portion 11F is formed on the top face of the front top wall 11 at a location proximate the second protruding wall 11B outwardly of the second protruding wall 11B in the connector width direction, and, in addition, at a location proximate the third protruding wall 11C outwardly of the third protruding wall 11C in the connector width direction. The top ridge portions 11F protrude from the top face of the front top wall 11 at the rear end of the front top wall 11 while extending in the forward-backward direction. The top ridge portions 11F are brought into biting engagement with the inner surface (bottom face) of the counterpart top wall 41 of the counterpart connector 2 when the connectors are in a mated state.

Bottom ridge portions 12A of the same shape as the top ridge portions 11F are formed on the bottom face of the front bottom wall 12 in the same positions as the top ridge portions 11F on the front top wall 11 when viewed in the up-down direction (see FIG. 5 (B)).

Figure 8:
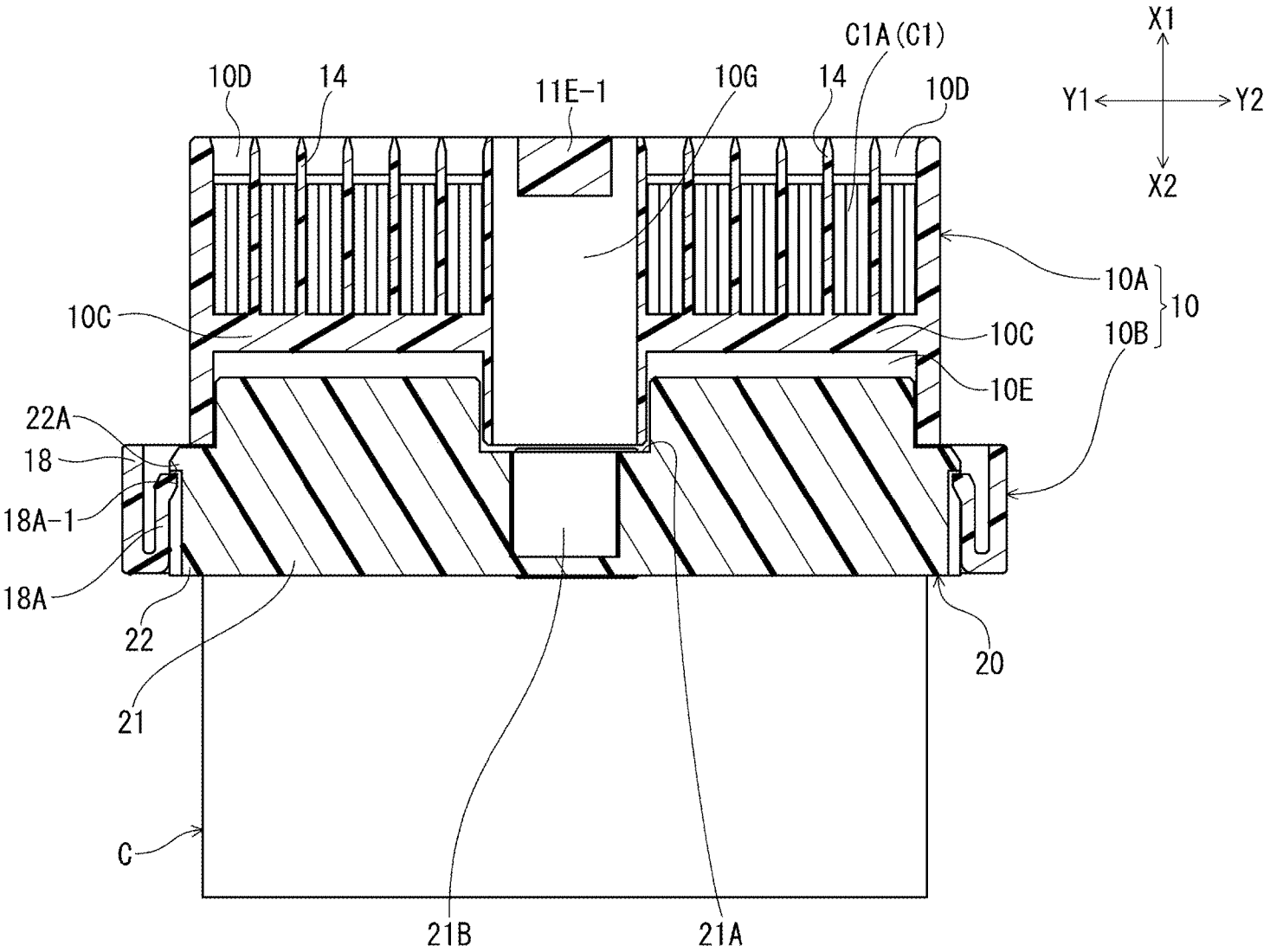
FIG. 8 illustrates a cross-sectional view of the electrical connector with a flat-type conductor of FIG. 1 that is perpendicular to the up-down direction and shows a cross-section taken across the lateral arm portions of the housing and the lateral engageable portions of the retainer.

As can be seen in FIGS. 5 (A) and 5 (B), the partition walls 14 are formed to be arranged at equal intervals in the connector width direction within the bounds of the two front receiving spaces 10D, in other words, the front receiving spaces 10D positioned on the opposite sides of the front holding space 10G-1 in the connector width direction (see also FIG. 8). The respective front receiving spaces 10D are split by these partition walls 14 in the connector width direction.

As can be seen in FIG. 3, the retainer installation portion 10B has a rear top wall 16 and a rear bottom wall 17 which extend in the connector width direction and are opposed in the up-down direction, and a pair of rear lateral walls 18 which extend in the up-down direction at the opposite ends in the connector width direction and couple the rear top wall 16 to the rear bottom wall 17. The retainer installation portion 10B is made larger than the mating portion 10A in the connector width direction, and the rear lateral walls 18 are positioned outwardly of the front lateral walls 13 in the connector width direction.

Limiting walls 16A, which protrude from the top face of the rear top wall 16, are formed on the rear top wall 16 on the opposite sides of the operative portion 11E-1A of the locking portion 11E at locations proximate the center in the connector width direction. The limiting walls 16A are positioned in a manner to permit abutment against the operative portion 11E-1A in the connector width direction in order to limit excessive resilient deformation of the locking portion 11E in the connector width direction. Rear top groove portions 16B, which are recessed from the bottom face of the rear top wall 16 while extending in the forward-backward direction, are formed in the rear top wall 16 at locations proximate the lateral edges in the connector width direction. The rear top groove portions 16B are open toward the rear and permit posterior entry of the top portions of the hereinafter-described support wall portions 22 of the retainer 20.

Figure 9A:
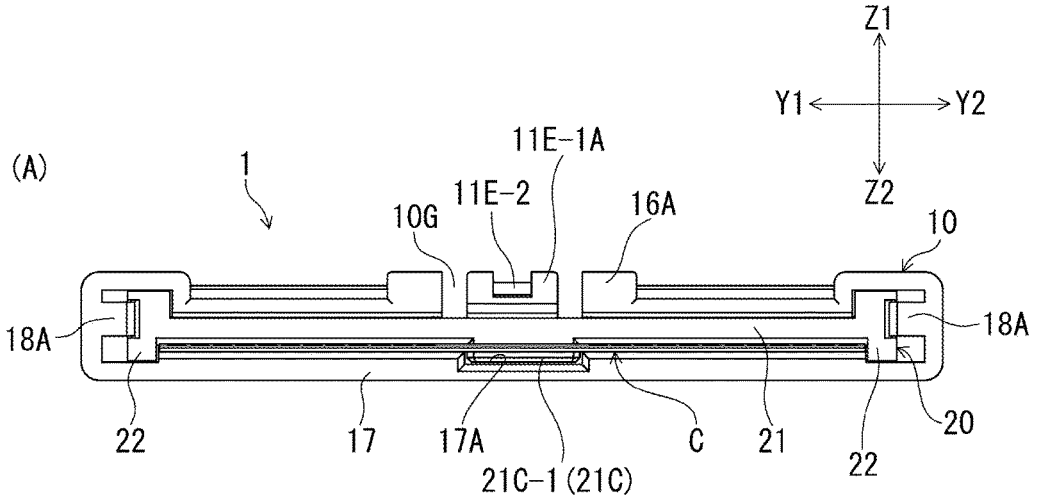
FIGS. 9 (A) and 9 (B) are posterior rear views of the electrical connector with a flat-type conductor of FIG. 1, and FIG. 9 (B) is a partial enlarged view of FIG. 9 (A).
Figure 9B:
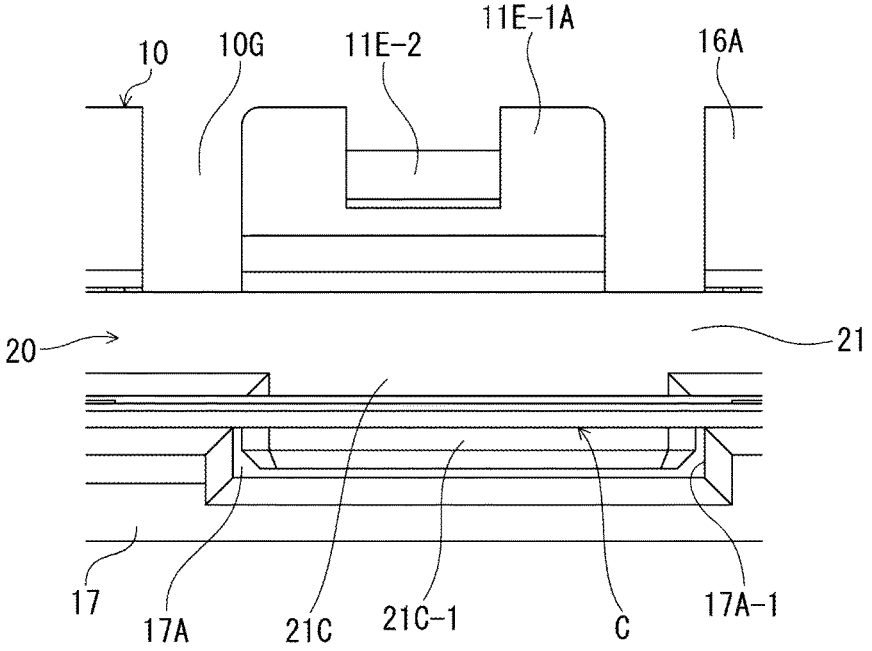

A groove-shaped limiting recessed portion 17A, which is positioned within the circuit-free range S in the connector width direction and extends in the forward-backward direction, is formed in the rear bottom wall 17. The limiting recessed portion 17A, which is positioned in alignment with the hereinafter-described protrusion 21C of the retainer 20 in the connector width direction and is open toward the rear, permits posterior entry of the protruding apex portion 21C-1 of the protrusion 21C of the retainer 20 (see FIG. 9 (B)). Among the inner surfaces of the limiting recessed portion 17A, the surfaces located on the opposite sides in the connector width direction (surfaces perpendicular to the connector width direction) serve as limiting faces 17A-1 capable of limiting the movement of the protruding apex portion 21C-1 and, by extension, the retainer 20, in the connector width direction. In addition, rear bottom groove portions 17B are formed in the rear bottom wall 17 in the same positions as the rear top groove portions 16B when viewed in the up-down direction. The rear bottom groove portions 17B, which are recessed from the top face of the rear bottom wall 17 and extend in the forward-backward direction while being open toward the rear, permit posterior entry of the bottom portions of the hereinafter-described support wall portions 22 of the retainer 20.

As can be seen in FIG. 8, lateral arm portions 18A, which extend from the inner surface of the rear end portions of the rear lateral walls 18 forwardly along said inner surface, are formed on the rear lateral walls 18. The lateral arm portions 18A have a cantilever configuration, in which the front end portions are free end portions and are resiliently deformable in the connector width direction. Lateral engagement protrusions 18A-1, which protrude inwardly in the connector width direction, are formed in the front end portions of the lateral arm portions 18A. The lateral engagement protrusions 18A-1 can engage the hereinafter-described lateral engageable portions 22A of the retainer 20 from the rear with their front end faces (flat faces perpendicular to the forward-backward direction) and prevent inadvertent decoupling of the retainer 20.

As can be seen in FIG. 3, in the present embodiment, anti-drip walls 10H, which protrude from the top face of the housing 10 outwardly of the limiting walls 16A in the connector width direction, are formed at the boundary between the mating portion 10A and the retainer installation portion 10B in the forward-backward direction. As can be seen in FIG. 2, these anti-drip walls 10H are positioned to seal gaps formed between the front top wall 11 of the connector 1 and the counterpart top wall 41 of the counterpart connector 2 when the connectors are in a mated state. Sealing the gaps in this manner with the anti-drip walls 10H prevents water droplets generated as a result of dew condensation outside the connector from penetrating the interior of the counterpart connector 2.

As can be seen in FIGS. 1 to 3, in the present embodiment, rearwardly open rear recessed portions 101 are formed rearwardly of the anti-drip walls 10H. Consequently, when the housing 10 is fabricated, the anti-drip walls 10H can be formed simply by disposing a mold (not shown) from the rear, molding the housing 10, and then pulling said mold backward. In other words, there is no need to use a plurality of molds to form the anti-drip walls 10H, and a mold of a simple shape can be used.

As can be seen in FIG. 3, the retainer 20 has a central plate portion 21 which extends such that the connector width direction is its longitudinal direction while having roughly the same dimensions as the strip width dimensions of the flat-type conductor C, and support wall portions 22 which are formed at the opposite ends of the central plate portion 21 in the connector width direction.

Figure 6A:
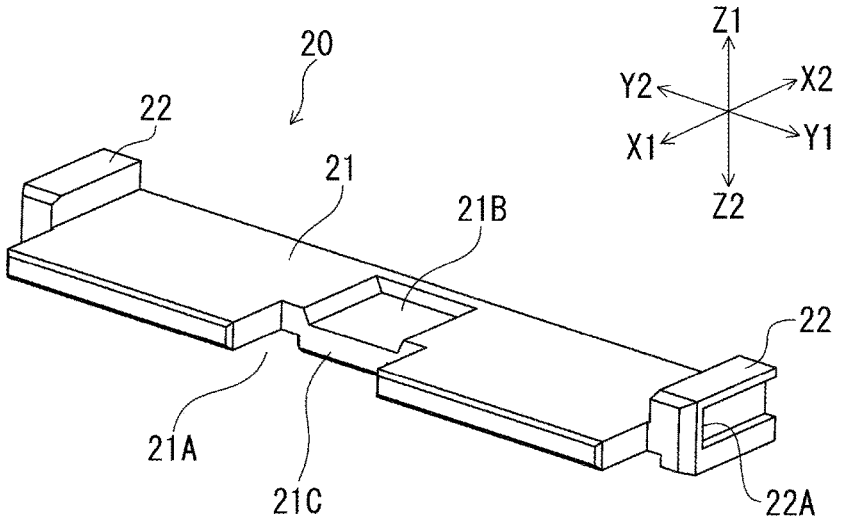
FIGS. 6 (A) and 6 (B) are views illustrating the retainer of the electrical connector with a flat-type conductor of FIG. 5 in isolation, where FIG. 6 (A) is an anterior perspective view, and FIG. 6 (B) is an anterior front view.
Figure 6B:
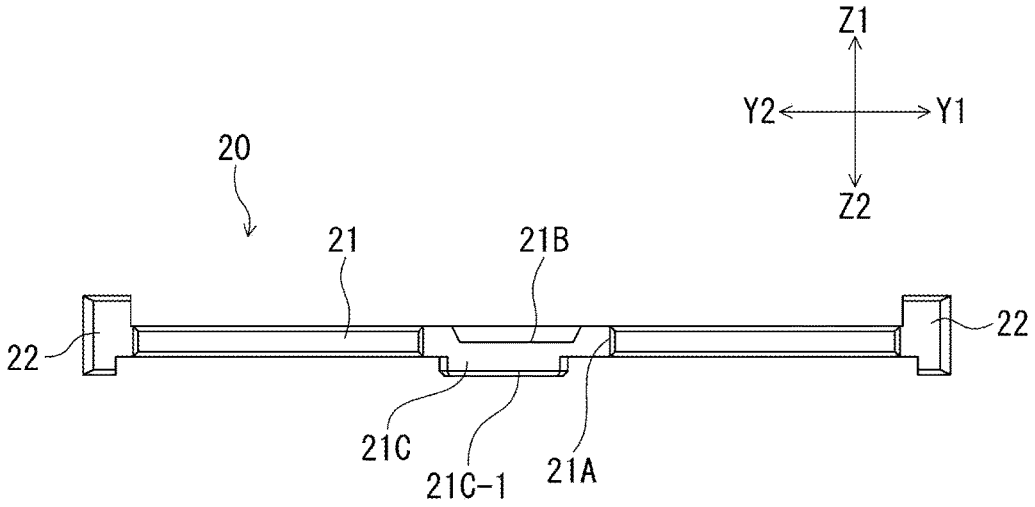

As can be seen in FIG. 3, the front end portion of the central plate portion 21 has a cutout made in the central area in the connector width direction, specifically, at a location corresponding to the circuit-free range S of the flat-type conductor, thereby forming a notched portion 21A (see FIG. 6 (A)). The fact that the notched portion 21A is forwardly open makes it possible to avoid interference between the retainer 20 and the housing 10 when the retainer 20 is attached to the housing 10 (see FIG. 8). A forwardly open top recessed portion 21B recessed from the top face of the central plate portion 21 is formed in the central area of the central plate portion 21 in the connector width direction at a location rearward of the notched portion 21A. The top recessed portion 21B is made smaller in size in the connector width direction than the notched portion 21A. When the retainer 20 is attached to the housing 10, the top recessed portion 21B is positioned under the operative portion 11E-1A of the locking portion 11E of the housing 10 (see FIG. 12 (B)), thereby allowing the operative portion 11E-1A and, by extension, the locking portion 11E, to be downwardly resiliently deformable to a sufficient extent.

Figure 7A:
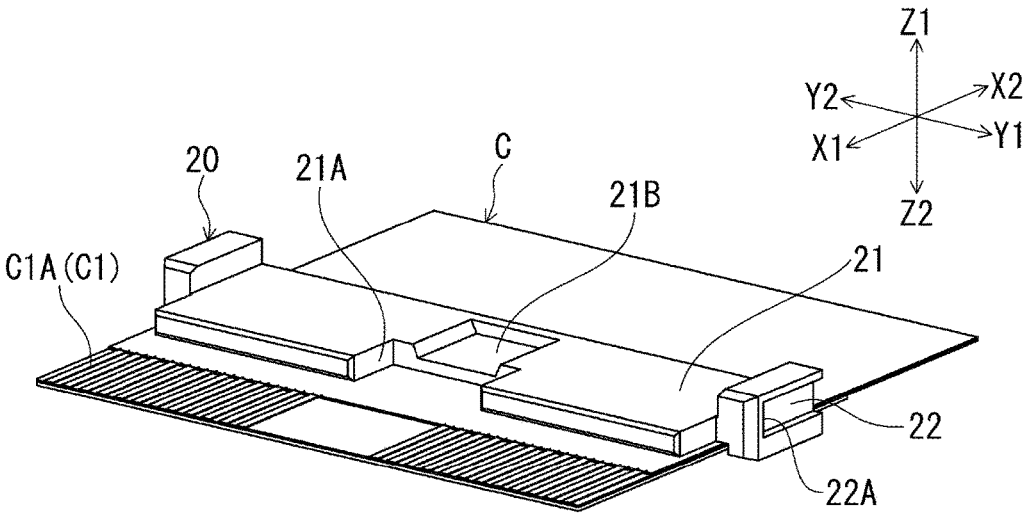
FIGS. 7 (A) and 7 (B) are perspective views illustrating the flat-type conductor with the retainer attached, where FIG. 7 (A) is a view from above, and FIG. 7 (B) is a view from below.
Figure 7B:
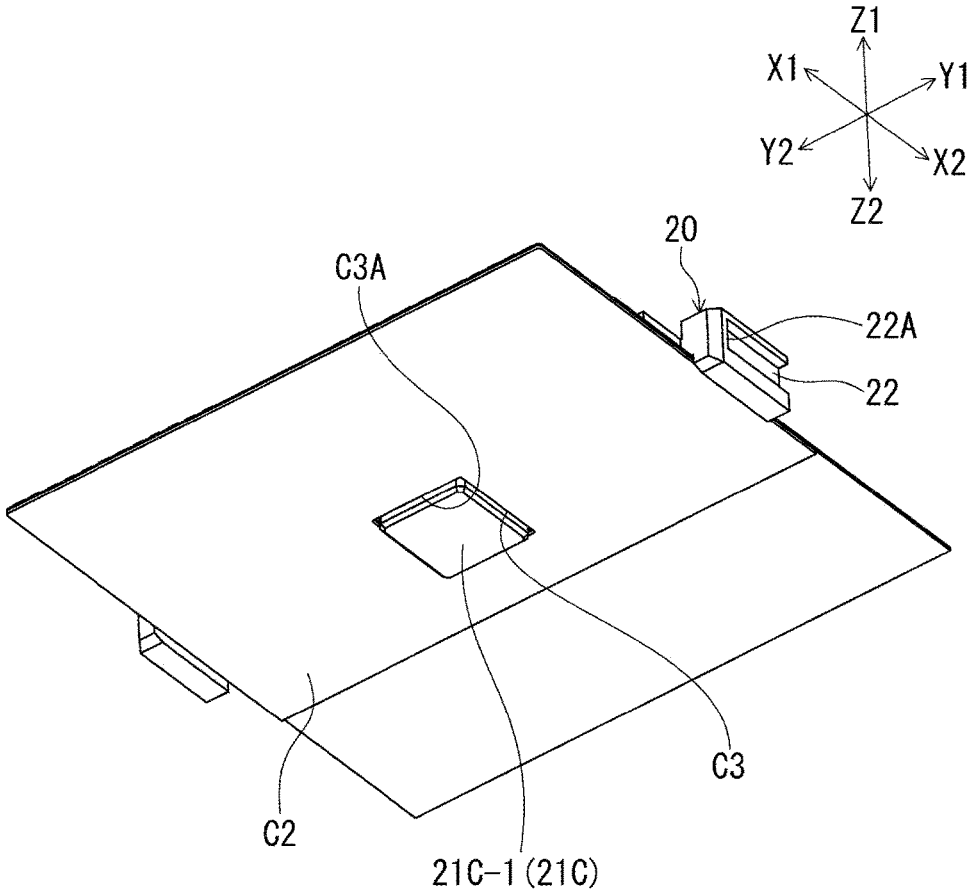

In addition, at a location within the circuit-free range S in the connector width direction and rearward of the notched portion 21A, the central plate portion 21 has a protrusion 21C of a generally rectangular prismatic shape that protrudes downwardly from the bottom face of the central plate portion 21. The protrusion 21C is positioned with a slight offset from the center toward side Y1, in alignment with the limiting recessed portion 17A of the housing 10 and the pass-through portion C3 of the flat-type conductor C in the connector width direction (see also FIG. 6 (B)). In cross-section perpendicular to the up-down direction, the protrusion 21C has a quadrangular shape that is slightly smaller than the pass-through portion C3 of the flat-type conductor C, which allows for it to be inserted into the pass-through portion C3 from above. The dimensions of the protrusion 21C in the up-down direction are larger than the thickness dimensions of the flat-type conductor C and, as can be seen in FIG. 7 (B), the protruding apex portion 21C-1 of the protrusion 21C inserted into the pass-through portion C3 protrudes downwardly past the pass-through portion C3 (see also FIGS. 9 (A) and 9 (B) and FIGS. 12 (B) and 12 (C)). In addition, the protrusion 21C is slightly smaller than the limiting recessed portion 17A of the housing 10 in the connector width direction and thus permits rear entry of the protruding apex portion 21C-1 of the protrusion 21C into the limiting recessed portion 17A when the retainer 20 is attached to the housing 10 (see FIGS. 9 (A) and 9 (B)).

The connector 1 is assembled in accordance with the following procedure. First, the protrusion 21C of the retainer 20 is inserted into the pass-through portion C3 in the front end section of the flat-type conductor C from above, thereby causing the protruding apex portion 21C-1 of the protrusion 21C to protrude downwardly through the pass-through portion C3. Next, with the protrusion 21C remaining inserted into the pass-through portion C3 (in the state illustrated in FIGS. 7 (A) and 7 (B)), the front end section of the flat-type conductor C and the retainer 20 are attached to the housing 10 from the rear. As a result, the front end section of the flat-type conductor C is inserted into the flat-type conductor insertion space 10F of the housing 10 from the rear, and the contact portions C1A of the flat-type conductor C reach the front receiving spaces 10D of the housing 10 (see FIG. 8 and FIG. 12 (A)).

In addition, in the process of attaching the retainer 20, the front ends of the lateral engageable portions 22A of the retainer 20 abut the lateral engagement protrusions 18A-1 of the lateral arm portions 18A and cause the lateral arm portions 18A to be resiliently deformed outwardly in the connector width direction, thereby permitting further insertion of the retainer 20. Once the lateral engageable portions 22A have passed the location of the lateral engagement protrusions 18A-1, the lateral arm portions 18A return to the free state, and the lateral engagement protrusions 18A-1 are positioned in a manner to permit engagement with the lateral engageable portions 22A from the rear (see FIG. 8), thereby preventing inadvertent decoupling of the retainer 20. In addition, the protruding apex portion 21C-1 of the protrusion 21C of the retainer 20 enters the limiting recessed portion 17A of the housing 10 from the rear (see FIG. 9 (B) and FIG. 12 (C)).

Figure 12A:
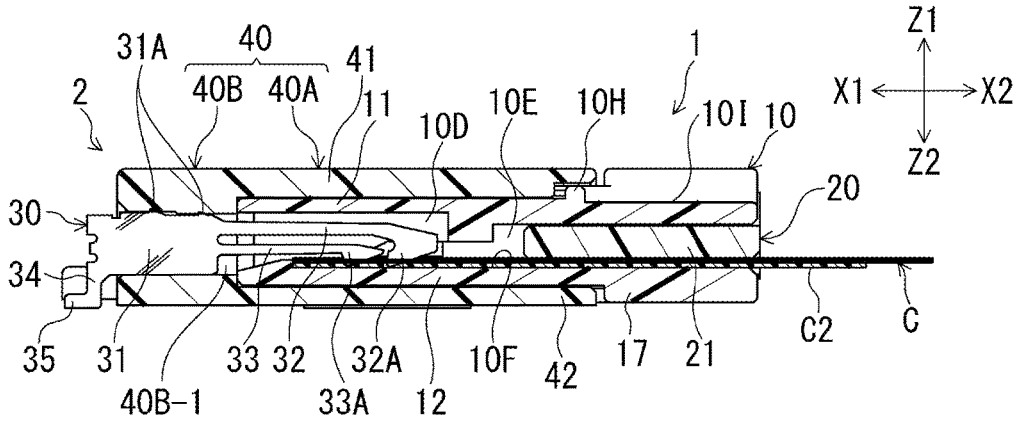
FIGS. 12 (A) to 12 (C) illustrate cross-sectional views of the electrical connector assembly of FIG. 2 taken in a plane perpendicular to the connector width direction, where FIG. 12 (A) is a cross-sectional view taken across the counterpart terminals, FIG. 12 (B) is a cross-sectional view taken across the locking portion of the housing and the protrusion of the retainer, and FIG. 12 (C) is a partial enlarged view of FIG. 12 (B).
Figure 12B:
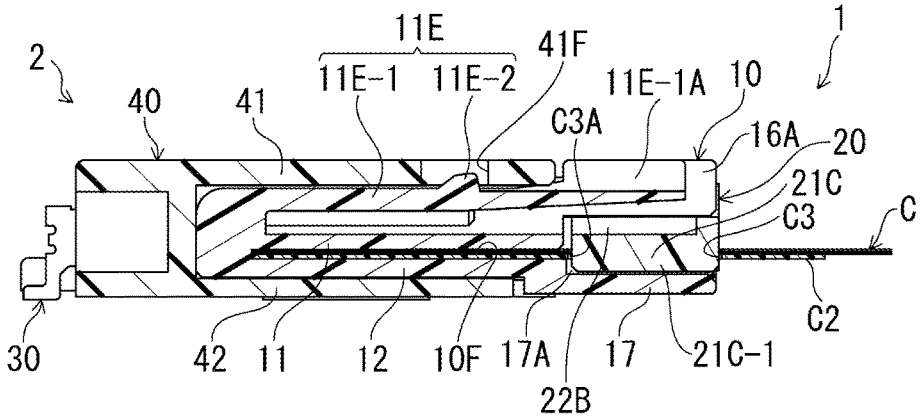
Figure 12C:
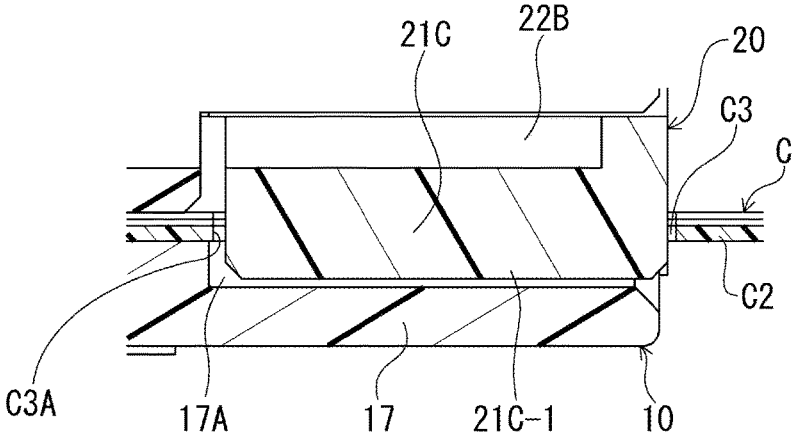

When the retainer 20 is attached to the housing 10, the protrusion 21C of the retainer 20 engages the front end edge C3A of the pass-through portion C3 of the flat-type conductor C (see FIG. 3, FIG. 7 (B), and FIG. 12 (C)) from the rear, which limits the rearward movement of the flat-type conductor C and prevents inadvertent decoupling of the flat-type conductor C. In addition, the protruding apex portion 21C-1 of the protrusion 21C is held within the limiting recessed portion 17A of the housing 10 and the movement of the protruding apex portion 21C-1 in the connector width direction is limited by the limiting faces 17A-1 of the limiting recessed portion 17A, thereby positioning the retainer 20 and the flat-type conductor C in the connector width direction. Attaching the retainer 20 to the housing 10 in this manner completes the assembly of the connector 1.

In the present embodiment, the rearward movement of the flat-type conductor C is limited and inadvertent decoupling of the flat-type conductor C from the housing 10 is prevented by introducing the protrusion 21C of the retainer 20 into the pass-through portion C3 of the flat-type conductor C and enabling engagement of the protrusion 21C with the front end edge C3A of the pass-through portion C3. Here, the pass-through portion C3 of the flat-type conductor C and the protrusion 21C of the retainer 20 are positioned within the circuit-free range S, in other words, within the range between the circuits C1 positioned at the outermost ends in the strip width direction of the flat-type conductor C (connector width direction). Employing the circuit-free range S of the flat-type conductor C in this manner eliminates the need to provide a mechanism for preventing the decoupling of the flat-type conductor C at more outer locations than the circuits C1 positioned at the opposite ends in the strip width direction, i.e., at the outermost ends in the strip width direction, as in the prior art, thereby making it possible to avoid an increase in the size of the connector 1 in the strip width direction while preventing inadvertent decoupling of the flat-type conductor C from the housing 10.

In addition, according to the present embodiment, the pass-through portion C3 of the flat-type conductor C is positioned within a range overlapping with the locking portion 11E of the housing 10 in the strip width direction within the circuit-free range S, which also helps avoid an increase in the size of the connector 1 in the strip width direction as compared to providing the pass-through portion C3 and the locking portion 11E at different locations in the connector width direction.

Figure 10:
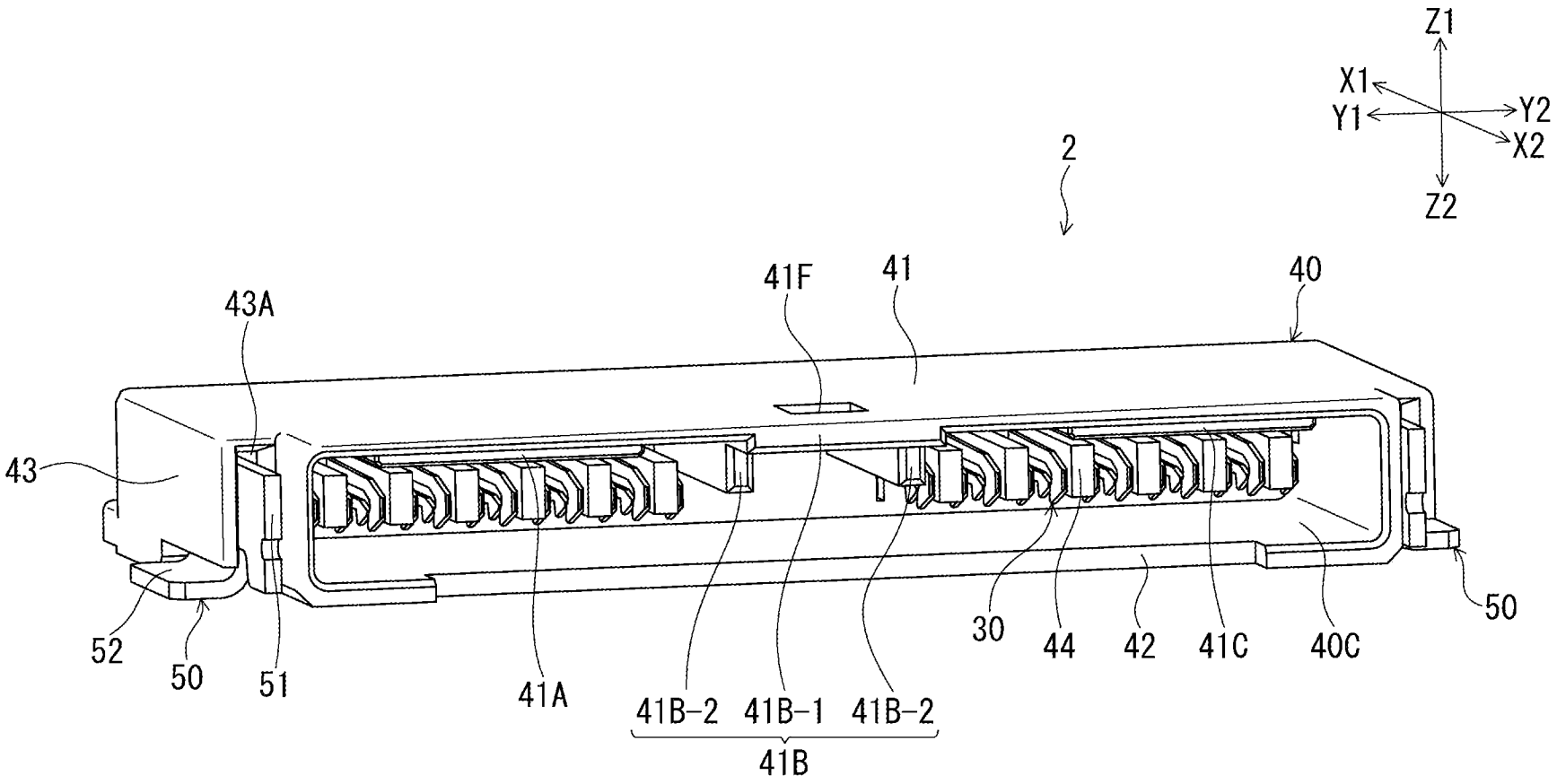
FIG. 10 illustrates a posterior perspective view of the counterpart electrical connector used in the electrical connector assembly of FIG. 1.

As can be seen in FIG. 10, the counterpart connector 2 has a plurality of counterpart terminals 30 arranged in alignment with the plurality of contact portions C1A of the flat-type conductor C of the connector 1 in the connector width direction (Y-axis direction), a counterpart housing 40 having a plurality of counterpart terminals 30 press-fitted and retained in place therein, and anchor fittings 50 press-fitted and retained in place within the counterpart housing 40 outside of the array range of the counterpart terminals 30 in the connector width direction.

Figure 11A:
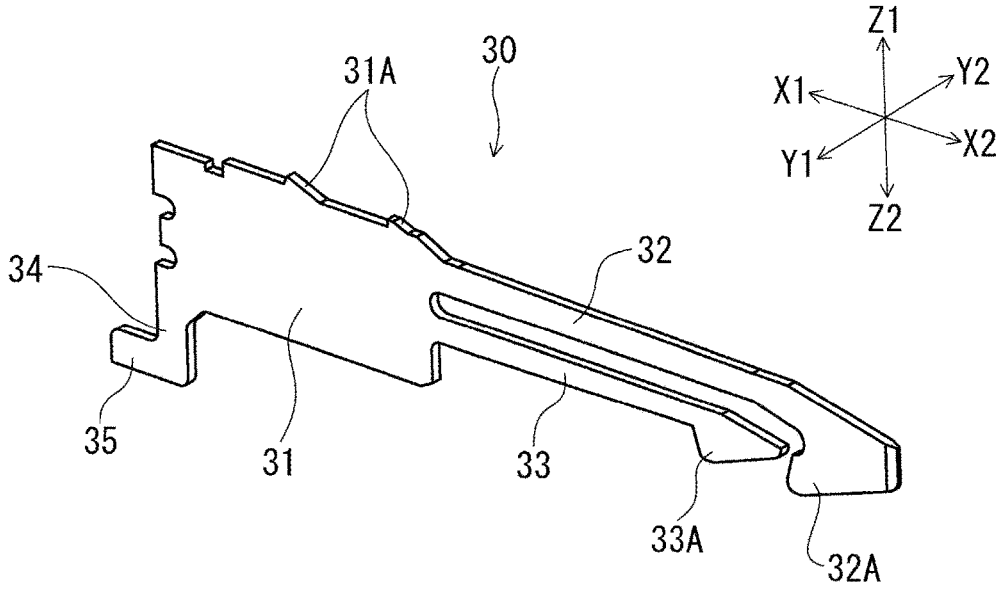
FIG. 11 (A) is a posterior perspective view of a counterpart terminal, and FIG. 11 (B) is a posterior perspective view of an anchor fitting.
Figure 11B:
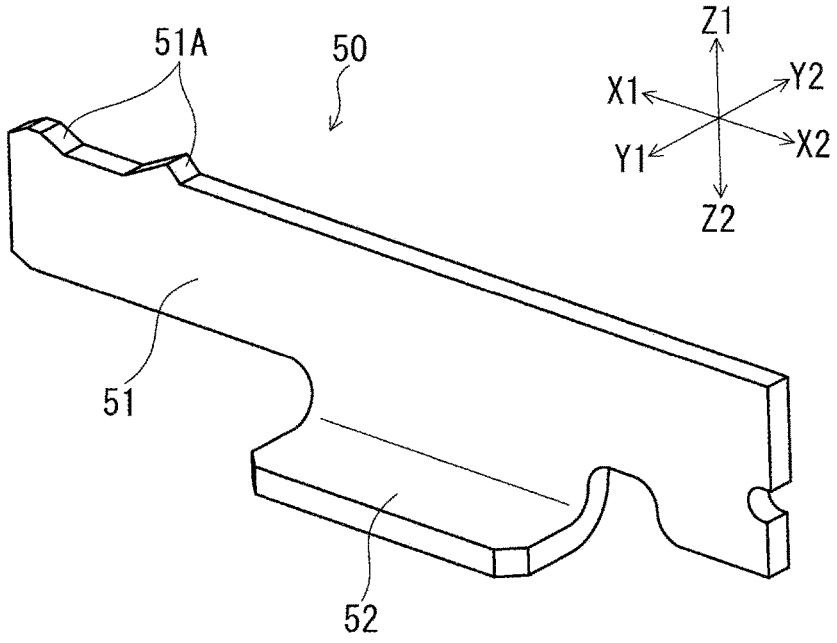

As can be seen in FIG. 11 (A), the counterpart terminals 30 are blanked out of a sheet metal member in the through-thickness direction and have a planar configuration with major faces maintaining their flatness. The counterpart terminals 30 are arranged in an orientation in which their through-thickness direction coincides with the connector width direction (Y-axis direction), and such that the direction of the terminal array is the connector width direction. In the present embodiment, the counterpart terminals 30 consist of two groups of counterpart terminals positioned in alignment with the two front receiving spaces 10D of the connector 1 in the connector width direction.

As can be seen in FIG. 11 (A), the counterpart terminals 30 each have a base portion 31 with a substantially quadrangular planar configuration, a long arm portion 32 and a short arm portion 33 extending rearwardly from the rear end edge (the end edge extending in the up-down direction on side X2) of the base portion 31, a leg portion 34 extending downwardly from the bottom edge of the front end portion of the base portion 31, and a connecting portion 35 extending forwardly from the bottom end of the leg portion 34.

The base portion 31 has formed therein press-fitting protrusions 31A that protrude from the upper edge of the base portion 31 at an intermediate location and a rear end location in the forward-backward direction. The counterpart terminals 30 are retained in place within the counterpart housing 40 as a result of being press-fitted from the front into the hereinafter-described counterpart terminal-retaining groove portions 40B-1 of the counterpart housing 40 such that the press-fitting protrusions 31A are brought into biting engagement with the inner surface of the counterpart terminal-retaining groove portions 40B-1 (see FIG. 12 (A)).

The long arm portion 32 extends rearwardly from the top rear end edge of the base portion 31 and is resiliently deformable in the up-down direction. A rear counterpart contact portion 32A, which is brought into contact with the contact portions C1A of the flat-type conductor C from above under contact pressure, is formed at the rear end of the long arm portion 32 so as to protrude downward in a substantially triangular configuration. In the up-down direction, the rear counterpart contact portion 32A protrudes to substantially the same height as the hereinafter-described front counterpart contact portion 33A of the short arm portion 33.

The short arm portion 33, which is positioned downwardly of the long arm portion 32 and extends rearwardly from the rear end edge of the vertically intermediate portion of the base portion 31, is resiliently deformable in the up-down direction. A front counterpart contact portion 33A, which is brought into contact with the contact portions C1A of the flat-type conductor C from above under contact pressure, is formed at the rear end of the short arm portion 33 so as to protrude downward in a substantially triangular configuration. The short arm portion 33 is made slightly shorter than the long arm portion 32, and the front end of the short arm portion 33 is positioned forwardly (on side X1) of the front end of the long arm portion 32. In other words, the front counterpart contact portion 33A of the short arm portion 33 is positioned forwardly of the rear counterpart contact portion 32A of the long arm portion 32.

As can be seen in FIG. 11 (A) and FIG. 12 (A), the rear counterpart contact portion 32A and the front counterpart contact portion 33A are located substantially at the same height and are positioned adjacent each other in the forward-backward direction. In addition, the rear counterpart contact portion 32A and the front counterpart contact portion 33A, which protrude past the bottom faces of the hereinafter-described nested portions 44 of the counterpart housing 40 and are positioned within the hereinafter-described counterpart receiving space 40C, are enabled to contact the contact portions C1A of the flat-type conductor C. In the present embodiment, making a two-point contact with the contact portions C1A possible in this manner ensures an adequate state of contact with the contact portions C1A.

The leg portion 34 extends downwardly from the bottom edge of the base portion 31 in a linear manner. When the counterpart connector 2 is mounted to a circuit board (not shown), the connecting portions 35 are positioned at the same height as the corresponding circuits (not shown) formed on the mounting face of the circuit board and can be solder-connected to said corresponding circuits.

As can be seen in FIG. 10, the counterpart housing 40 has a substantially rectangular parallelepiped-like exterior configuration whose longitudinal direction is the connector width direction (Y-direction) and, as can be seen in FIG. 12 (A), along with having a counterpart mating portion 40A used for mating with the housing 10 of the connector 1 in substantially the rear half, has a counterpart terminal-retaining portion 40B used for retaining the counterpart terminals 30 in place by press-fitting in substantially the front half.

The counterpart mating portion 40A has a counterpart top wall 41 and a counterpart bottom wall 42 that serve as counterpart mating walls extending in the connector width direction and opposed in the up-down direction, a pair of counterpart lateral walls 43 extending in the up-down direction at the opposite ends in the connector width direction and coupling the counterpart top wall 41 to the counterpart bottom wall 42, and nested portions 44 extending forwardly from the rear end face of the counterpart terminal-retaining portion 40B through the interior space of the counterpart mating portion 40A. The rearwardly open space enclosed by the counterpart top wall 41, counterpart bottom wall 42, and counterpart lateral walls 43 is formed to serve as a counterpart receiving space 40C intended for receiving the mating portion 10A of the connector 1.

At three locations in the connector width direction, the counterpart top wall 41 has formed therein counterpart protruding walls 41A-41C that protrude from the bottom face of the counterpart top wall 41 while extending in the forward-backward direction. Specifically, as can be seen in FIG. 10, the counterpart protruding walls 41A-41C include a first counterpart protruding wall 41A, a second counterpart protruding wall 41B, and a third counterpart protruding wall 41C arranged successively in a spaced relationship from side Y1 to side Y2. The second counterpart protruding wall 41B is made narrower in width than the first counterpart protruding wall 41A and the third counterpart protruding wall 41C.

The second counterpart protruding wall 41B includes a main protruding wall 41B-1, which protrudes to substantially the same dimension in the up-down direction as the first counterpart protruding wall 41A and the second counterpart protruding wall 41B and two auxiliary protruding walls 41B-2, which protrude downwardly at two locations on the opposite sides of the main protruding wall 41B-1 in the connector width direction.

The first counterpart protruding wall 41A is positioned in alignment with the space between the first protruding wall 11A and the second protruding wall 11B of the connector 1 in the connector width direction. The main protruding wall 41B-1 of the second counterpart protruding wall 41B is positioned in alignment with the space between the second protruding wall 11B and the third protruding wall 11C in the connector width direction. The two auxiliary protruding walls 41B-2 of the second counterpart protruding wall 41B are positioned in alignment with, respectively, the space between the locking arm portion 11E-1 and the second protruding wall 11B, and the space between the locking arm portion 11E-1 and the third protruding wall 11C of the connector 1 in the connector width direction. The third counterpart protruding wall 41C is positioned in alignment with the space enclosed by the locking arm portion 11E-1, third protruding wall 11C, and fourth protruding wall 11D of the connector 1 in the connector width direction.

In addition, a locking aperture 41F, which extends through the counterpart top wall 41 in the up-down direction, is formed in the rear end portion of the counterpart top wall 41 at a central location in the connector width direction, i.e., at a location between the two auxiliary protruding walls 41B-2. As described hereinafter, the locking aperture 41F serves to prevent the decoupling of the connector 1 by engaging the locking protrusion 11E-2 of the connector 1 (see FIG. 12 (B)).

As can be seen in FIG. 10, forwardly and downwardly open fitting-retaining groove portions 43A extending in the forward-backward direction are formed in the counterpart lateral walls 43 in a slit-shaped configuration extending in a direction perpendicular to the connector width direction.

The nested portions 44 have a plurality of nested ridge portions 44A arranged in the connector width direction within the respective array ranges of the previously discussed two counterpart terminal groups. The nested ridge portions 44A are positioned between the counterpart terminals 30 and extend rearwardly from the rear face of the counterpart terminal-retaining portion 40B. When the counterpart terminals 30 are retained in place within the counterpart housing 40, the rear counterpart contact portion 32A and front counterpart contact portion 33A of the counterpart terminals 30 protrude downwardly past the bottom faces of the nested ridge portions 44A.

As can be seen in FIG. 12 (A), the counterpart terminal-retaining portion 40B has formed therein counterpart terminal-retaining groove portions 40B-1 used for retaining the counterpart terminals 30 in place by press-fitting, which are formed through the counterpart terminal-retaining portion 40B in the forward-backward direction. The counterpart terminal-retaining groove portions 40B-1, which have a slit-shaped configuration extending perpendicular to the connector width direction, are formed in an array in the connector width direction.

As can be seen in FIG. 11 (B), the anchor fittings 50 are made by bending a sheet metal member in the through-thickness direction. The anchor fittings 50 have a retained plate portion 51, which has major faces perpendicular to the connector width direction and extends in the forward-backward direction, and an anchoring portion 52, which is made by bending the bottom edge of the retained plate portion 51 at right angles at an intermediate location of the retained plate portion 51 in the forward-backward direction and which extends outwardly in the connector width direction. The retained plate portion 51 has two press-fitting protrusions 51A protruding from the upper edge of the front end portion. As a result of being press-fitted into the fitting-retaining groove portions 43A of the counterpart housing 40 from the rear such that the press-fitting protrusions 51A are brought into biting engagement with the inner surface of the fitting-retaining groove portions 43A, the anchor fittings 50 are retained in place within the counterpart housing 40. The anchoring portions 52 are secured to corresponding portions (not shown) formed as pads on the mounting face of the circuit board by solder-connecting the bottom faces of the anchoring portions 52 to the corresponding portions.

The counterpart connector 2 is assembled in accordance with the following procedure. First, the base portions 31 of the counterpart terminals 30 are press-fitted into the counterpart terminal-retaining groove portions 40B-1 of the counterpart housing 40 from the front. In addition, the retained plate portions 51 of the anchor fittings 50 are press-fitted into the fitting-retaining groove portions 43A of the counterpart housing 40 from the rear. As a result, the counterpart terminals 30 and anchor fittings 50 are retained in place within the counterpart housing 40, which completes the assembly of the counterpart connector 2. The order of attachment (press-fitting) of the counterpart terminals 30 and the anchor fittings 50 to the counterpart housing 40 is not limited to the order described above, and either may be attached first or, alternatively, the attachment may be simultaneous.

The connector 1 and counterpart connector 2 are matingly connected in accordance with the following procedure. First, the counterpart connector 2 is mounted to a circuit board (not shown) by solder-connecting the connecting portions 35 of the counterpart terminals 30 of the counterpart connector 2 to the corresponding circuits of the circuit board as well as solder-connecting the anchoring portions 52 of the anchor fittings 50 to the corresponding portions of the circuit board.

Next, as can be seen in FIG. 1, after positioning the connector 1 at the rear of the counterpart connector 2, the connector 1 is moved forward, thereby mating the mating portion 10A of the connector 1 with the counterpart mating portion 40A of the counterpart connector 2 from the rear.

In the process of connector mating, the mating portion 10A enters the counterpart receiving space 40C from the rear and the locking protrusion 11E-2 of the locking arm portion 11E-1 abuts the rear end portion of the counterpart top wall 41 of the counterpart housing 40, as a result of which it is resiliently displaced downward, enabling further advancement of the connector 1. In addition, in the process of connector mating, the protruding walls 11A-11D of the connector 1 enter the corresponding spaces in the counterpart connector 2 from the rear and the counterpart protruding walls 41A-41C of the counterpart connector 2 enter the corresponding spaces in the connector 1 from the front. As a result, the fact that the misalignment of the protruding walls 11A-11D in the connector width direction is limited by the counterpart protruding walls 41A-41C ensures that the connector 1 is guided forward in an effortless manner.

As the connector 1 advances further and the locking protrusion 11E-2 reaches the location of the locking aperture 41F of the counterpart top wall 41, the locking arm portion 11E-1 returns to the free state and the locking protrusion 11E-2 enters the locking aperture 41F from below. As a result, as can be seen in FIG. 12 (A), the locking protrusion 11E-2 is enabled to rearwardly engage the inner surface of the locking aperture 41F, thereby producing a locked state in which inadvertent decoupling of the counterpart connector 2 is prevented.

In addition, in the process of connector mating, the nested ridge portions 44A of the nested portions 44 of the counterpart housing 40, as well as long arm portions 32 and short arm portions 33 of the counterpart terminals 30 arranged by the nested ridge portions 44A, enter the corresponding front receiving spaces 10D, in other words, the respective front receiving spaces 10D separated by the plurality of partition walls 14 in the connector 1 from the front. As a result, the long arm portions 32 and short arm portions 33, while being resiliently deformed upward, are brought into contact with the contact portions C1A of the flat-type conductor C under contact pressure with the help of the rear counterpart contact portions 32A and front counterpart contact portions 33A (see FIG. 12 (A)). As a result, the flat-type conductor C and counterpart terminals 30 are placed in electrical communication.

Although in FIG. 12 (A) the arm portions 32, 33 are illustrated in a state in which none of them is subject to resilient deformation and the counterpart contact portions 32A, 33A overlap with the contact portions C1A of the flat-type conductor C, in actual fact, as discussed previously, the arm portions 32, 33 are subject to resilient deformation and the counterpart contact portion 32A, 33A are brought into contact with the protruding apex portions of the contact portions C1A of the flat-type conductor C.

In addition, the top ridge portions 11F of the front top wall 11 of the connector 1 and the bottom ridge portions 12A of the front bottom wall 12 are brought into biting engagement with the bottom face of the counterpart top wall 41 and the top face of the counterpart bottom wall 42, respectively, and assist in positioning both connectors 1, 2 in the connector width direction as well as in the up-down direction.

Although in the present embodiment the locking portion 11E of the connector 1 is provided with a single locking arm portion 11E-1, alternatively, the locking portion may include a plurality of locking arm portions positioned in a spaced relationship in the connector width direction. Providing a plurality of locking arm portions in this manner allows for front receiving spaces to be formed in the housing at locations between mutually adjacent locking arm portions, as a result of which the number of circuits of the flat-type conductor and, by extension, the number of the counterpart terminals of the counterpart connector can be increased without making the connector larger in the connector width direction. In addition, forming thin locking arm portions makes it easier for the locking arm portions to undergo resilient deformation.

Although in the present embodiment the locking portion 11E was provided at a location that is within a range overlapping with the receiving spaces 10D, 10E of the housing 10 in the forward-backward direction, alternatively, the locking portion may be provided rearwardly of the receiving spaces without overlapping with the receiving spaces in the forward-backward direction. Even if the locking portion is provided rearwardly of the receiving spaces in this manner, as long as the locking portion is positioned within a range overlapping with the receiving spaces in the up-down direction, connector profile reduction will be achieved in exact proportion to the overlap.

Although in the present embodiment the overlap of the locking portion 11E with the receiving spaces 10D, 10E in the up-down direction was confined to a portion, specifically, a bottom portion of the locking arm portion 11E-1, alternatively, the entire locking arm portion may be made to overlap with the receiving spaces in the up-down direction and, furthermore, the entire locking portion may be made to overlap with the receiving spaces in the up-down direction. In this manner, the effect of connector profile reduction is improved in exact proportion to the increase in the size of the overlap between the locking portion and the receiving spaces.

Although in the present embodiment the flat-type conductor C is a whole, single flat-type conductor that is not split in the connector width direction, alternatively, the flat-type conductor may be formed as multiple flat-type conductor units split in the connector width direction. In such a case, the multiple flat-type conductor units can be adjacent in a spaced relationship in the connector width direction, and the ranges of the intervals therebetween can be used as circuit-free ranges. If the circuit-free ranges are formed in this manner between the flat-type conductor units, then locking portions can be formed in the housing within the circuit-free ranges in the connector width direction. In addition, notched portions that open toward each other in the connector width direction can be formed in the respective lateral edge portions (edge portions extending in the forward-backward direction) of two mutually adjacent flat-type conductor units positioned on the opposite sides of a circuit-free range to serve as a pass-through portion, and the protrusion of the retainer can be introduced into this pass-through portion in the up-down direction. As a result, the protrusion will be able to engage the front end edge of each notched portion from the rear and will be able to prevent inadvertent decoupling by limiting the rearward movement of each flat-type conductor unit.

DESCRIPTION OF THE REFERENCE NUMERALS

1 Connector (electrical connector with a flat-type conductor)
2 Counterpart connector (counterpart electrical connector)
10 Housing
10D Receiving spaces
10E Rear receiving space (holding space)
11E Locking portion
11E-1 Locking arm portion
11E-2 Locking protrusion (locking engagement portion)
17 Rear bottom wall
17A Limiting recessed portion (recessed portion)
20 Retainer
21C Protrusion
21C-1 Protruding apex portion
C Flat-type conductor
C1 Circuits
C3 Pass-through portion

The invention claimed is:

1. An electrical connector with a flat-type conductor for matingly connecting a front end section of a flat-type conductor with a strip-like configuration extending in a forward-backward direction to a counterpart electrical connector, said electrical connector with a flat-type conductor comprising;

said flat-type conductor, which has formed therein a plurality of circuits extending in a forward-backward direction that are arranged in a strip width direction of the flat-type conductor, a housing holding the front end section of the flat-type conductor, and a retainer attached to the housing for supporting the front end section of the flat-type conductor, wherein the housing comprises a locking portion, which is positioned within a range between the circuits positioned at outermost ends in the strip width direction of the flat-type conductor and is lockable to the counterpart electrical connector, and a holding space, which holds the retainer along with the front end section of the flat-type conductor, the front end section of the flat-type conductor has formed therein a pass-through portion extending through the flat-type conductor in a thickness direction of said flat-type conductor at a location at least partially overlapping with the locking portion in the strip width direction, the retainer has a protrusion that protrudes in the thickness direction of the flat-type conductor and enters the pass-through portion of the flat-type conductor, so as to limit rearward movement of the flat-type conductor with a function of said protrusion, the protrusion of the retainer is positioned so as to be inserted into the pass-through portion of the flat-type conductor such that a protruding apex portion protrudes from the pass-through portion, and in walls that form the holding space, the housing has a recessed portion that permits entry of the protruding apex portion of the protrusion, so as to limit the movement of the protrusion in the strip width direction of the flat-type conductor along an inner surface of said recessed portion.

2. An electrical connector with a flat-type conductor for matingly connecting a front end section of a flat-type conductor with a strip-like configuration extending in a forward-backward direction to a counterpart electrical connector, said electrical connector with a flat-type conductor comprising;

said flat-type conductor, which has formed therein a plurality of circuits extending in a forward-backward direction that are arranged in a strip width direction of the flat-type conductor, a housing holding the front end section of the flat-type conductor, and a retainer attached to the housing for supporting the front end section of the flat-type conductor, wherein the housing comprises a locking portion, which is positioned within a range between the circuits positioned at outermost ends in the strip width direction of the flat-type conductor and is lockable to the counterpart electrical connector, and a holding space, which holds the retainer along with the front end section of the flat-type conductor, the front end section of the flat-type conductor has formed therein a pass-through portion extending through the flat-type conductor in a thickness direction of said flat-type conductor at a location at least partially overlapping with the locking portion in the strip width direction, and the retainer has a protrusion that protrudes in the thickness direction of the flat-type conductor and enters the pass-through portion of the flat-type conductor, so as to limit rearward movement of the flat-type conductor with a function of said protrusion, the protrusion of the retainer is positioned so as to be inserted into the pass-through portion of the flat-type conductor such that a protruding apex portion protrudes from the pass-through portion, in walls that form the holding space, the housing has a recessed portion that permits entry of the protruding apex portion of the protrusion, so as to limit the movement of the protrusion in the strip width direction of the flat-type conductor along an inner surface of said recessed portion, and the recessed portion of the housing is formed in a shape of a rearwardly open groove extending in the forward-backward direction and permits entry of the protruding apex portion of the retainer from rear.

* * * * *